United States Patent [19]

Rothenstein et al.

[11] 4,163,681

[45] Aug. 7, 1979

[54] DESENSITIZED EXPLOSIVES AND CASTABLE THERMALLY STABLE HIGH ENERGY EXPLOSIVE COMPOSITIONS THEREFROM

[75] Inventors: Julius Rothenstein, Citrus Heights; Samuel Goldhagen, Sacramento, both of Calif.

[73] Assignee: The United States of America as represented by the Secretary of the Navy, Washington, D.C.

[21] Appl. No.: 28,991

[22] Filed: Apr. 15, 1970

[51] Int. Cl.[2] ..... C06B 45/22

[52] U.S. Cl. ..... 149/11; 149/7; 149/19.4; 149/19.6; 149/19.91; 149/44; 149/92; 149/113; 149/114; 149/115

[58] Field of Search ..... 149/11, 92, 7, 19.4, 149/19.6, 19.91

[56] References Cited

U.S. PATENT DOCUMENTS

| | | | |
|---|---|---|---|
| 2,867,647 | 1/1959 | Cow et al. | 149/11 |
| 3,118,797 | 1/1964 | Coffee | 149/11 |
| 3,138,496 | 6/1964 | Monical | 149/11 |
| 3,236,702 | 2/1966 | Sapiego | 149/11 X |
| 3,266,957 | 8/1966 | Stresau | 149/11 |
| 3,304,211 | 2/1967 | Anderson et al. | 149/11 |
| 3,318,739 | 5/1967 | Voigt, Jr. | 149/11 |

*Primary Examiner*—Leland A. Sebastian

*Attorney, Agent, or Firm*—R. S. Sciascia; A. L. Branning

[57] ABSTRACT

This patent describes a novel desensitized explosive wherein a normally sensitive solid explosive material is coated with an effective desensitizing amount of a phlegmatizing agent which contains functional groups reactive with one or more ingredients conventionally used in forming a thermally stable, crosslinked solid composite explosive. The present invention also includes thermally stable, crosslinked solid composite explosive in which said desensitized explosives are an integral part. Still further this invention includes the method of coating the as-received explosive material with said phlegmatizing agent, preferably in a drying vessel at elevated temperatures.

14 Claims, No Drawings

DESENSITIZED EXPLOSIVES AND CASTABLE THERMALLY STABLE HIGH ENERGY EXPLOSIVE COMPOSITIONS THEREFROM

BACKGROUND OF THE INVENTION

In the field of composite explosives, one specific characteristic that has served as an impediment to widespread processing and production of conventional, and especially of new classes of explosives, is the limited number of neat high explosives that are able to meet the Bureau of Explosives requirements for handling and transporting. Consequently, various techniques, such as blending or coating the explosive with a phlegmatizing agent, are usually employed to overcome this limitation, but in general these techniques are themselves subject to other limitations. For example, coatings often (1) are cumbersome to apply, (2) are difficult to adapt to production of composite explosives because of incompatibility with other ingredients that are later blended with the desensitized explosive, (3) lower the detonation energy and detonation pressure of the explosive because an excessive quantity of phlegmatizing agent is often required for adequate desensitization, (4) do not permit adequate removal of water or other diluent from the as-received explosive because of inherent chemical or physical processing difficulties, and (5) introduce undesirable additional costs to the process. Specifically, as-received cyclotrimethylene trinitramine (RDX) and cyclotetramethylene tetranitramine (HMX) have been blended or coated with various wax-type phlegmatizing agents in explosive compositions, which include a range of concentrations of inert, non-reactive desensitizing waxes.

We have now discovered desensitized explosives that are able to meet the Bureau of Explosives requirements for handling and transporting, which also avert the usual limitations associated with conventionally desensitized explosives, by coating sensitive materials such as RDX and HMX with a phlegmatizing agent that has potentially chemically reactive groups, such that the phlegmatizing agent ultimately may become an integral part of a thermally stable, crosslinked polymeric structure, capable of being cast in place at mild, ambient temperature into any desired shape or mold. In addition, the desensitizing agent has specific characteristics such that it can easily be fabricated into a castable and curable composite explosive whose cure rate and flexibility can both be varied within a wide range by appropriate, readily made changes in the formulation. Moreover, the composite explosives that can be fabricated from such desensitized neat explosives exhibit very low degrees of shrinkage, have glass transition temperatures below −65° F., have excellent thermal stability (gas evolution less than 2 cc/gram after 48 hours at 120° C.), and demonstrate high detonation pressures and detonation energies. No known high explosive combines the characteristics of insensitivity and ability to meet Bureau of Explosives requirements for handling and shipping with the capacity for ready formulation into composite explosives that are compatible and exhibit all the aforementioned characteristics. Since there are current explosive applications that require many of the designated characteristics, and some applications that require all of them in a single composite explosive, the availability of desensitized, neat explosives which are amenable to fabrication into single composite explosives that achieve this combination of properties represents a distinctly new approach in the art of explosive compounding.

SUMMARY OF THE INVENTION

Briefly, the present invention comprises a novel desensitized explosive wherein a normally sensitive solid explosive material is coated with an effective desensitizing amount of a phlegmatizing agent which contains functional groups reactive with one or more ingredients conventionally used in forming a thermally stable crosslinked, solid composite explosive. The present invention also includes thermally stable, crosslinked solid composite explosive in which said desensitized explosives are an integral part. Still further this invention includes the method of coating the as-received explosive material with said phlegmatizing agent, preferably in a drying vessel at elevated temperatures.

It is an object of our invention to provide a novel desensitized explosive material.

It is also an object of this invention to provide a novel solid composite explosive.

A further object of the invention is to overcome many of the handling problems previously associated with explosives.

These and other objects of this invention will be apparent from the more detailed description which follows.

DESCRIPTION OF PREFERRED EMBODIMENTS

We have been able to achieve the desired properties described above by drying and simultaneously coating as-received RDX (or HMX) with compatible, desensitizing materials containing functional groups capable of later reaction with other materials which may be blended together with the desensitized, neat explosive, to form a thermally stable, crosslinked polymeric network as an integral part of a castable composite explosive. It is preferred, but not essential, that the potentially reactive desensitizing material be required in such concentration in the composite explosive as to be able to contribute a coating level sufficient to desensitize the neat explosive to impact, friction and spark initiation.

If desired, however, other materials may be added prior to, during, or after application of the primary coating agent to confer additional specific properties upon the coated, desensitized explosive. For example, materials preferred as co-coating agents may be plasticizing agents with varying degrees of compatibility with the primary coating agent as to be capable of modifying the melting range of the latter and, hence, the preferred discharge temperature of the coated explosive from the coating equipment.

Alternately, or additionally, the materials may be surface active agents with varying degrees of compatibility with the primary coating agent as to be capable of altering the distribution and homogeneity of the coating on the surface of the explosive, and/or the ultimate processability of the coated explosive into a crosslinked, composite explosive.

The co-coating agents may also be materials with chemical groups having specific affinity, both for the explosive and for the potential crosslinked polymer network, as to improve the bond between the explosive and said polymeric network and thus contribute to superior mechanical properties of the composite explosive. Co-coating agents of varying molecular weight, either chemically similar to, or different from, the primary coating agent, may be applied with said primary coating agent to permit a range of potential mechanical properties in the crosslinked composite explosive.

If a desensitized, coated explosive with potentially higher detonation pressure and detonation energy is desired, reactive or non-reactive energetic coating agents may be applied either together with or independent of the primary coating agent, to impart sufficient desensitization to meet the Bureau of Explosives requirements for handling and transporting and yet be readily fabricated into thermally stable, crosslinked composite explosives.

The potentially chemically reactive desensitizing agent that is readily applied to as-received explosives such as RDX or HMX, such that the explosives are never in a sensitized state for handling and transporting and, such that the desensitizing agent is later capable of becoming an integral part of a crosslinked polymeric network, is one of a class of compounds with a range of molecular weights that includes, but is not limited to, the polyoxyethylene glycols with functional hydroxyl groups capable of forming polyurethanes. A desensitizing agent with a potentially reactive functional group is a necessary, but not a sufficient feature of this invention; the desensitizer must, additionally, be stable to the temperature conditions required during the drying and coating operation on the as-received explosive and should not contribute to degradation of the explosive under these conditions or during use; said desensitizer should impart uniform desensitization to the explosive at sufficiently low concentrations, so as not to unduly dilute the potential explosive characteristics; and, said desensitizer must have physical and chemical characteristics when coated on the explosive in the required concentration, such that the coated explosive can be processable and storable with negligible migration or other such loss of coating agent that would otherwise alter its sensitivity and/or its capacity to be fabricated ultimately into a composite, crosslinked compatible explosive with high detonation energy and detonation pressure.

We have found that elastomeric polymers, such as but not limited to polar polyoxyethylene glycols, in a range of useful molecular weights, are particularly suitable for simultaneously drying, and coating as-received RDX or HMX to form desensitized, processable explosives, capable of extended storage without migration or loss of the desensitizing coating, and, which can be readily formulated at any time into compatible, highly energetic composite explosives, containing high concentrations of energetic polar plasticizers, that are capable of polymerization to thermally stable, rigid or flexible structures under mild conditions.

The desensitizing agents are not limited to the polyoxyethylene glycol type compounds. For example, polycarboxylic acids can be used as a desensitizing agent for explosives which are later cured with triepoxides or tri-imines to form castable high energy explosive compositions. Or, surface active agents or other materials with hydroxyl functionality in addition to types represented by polyoxyethylene glycols, such as glycerol monoricinoleate or polyvinyl alcohol, can also be used similarly and subsequently cured to form crosslinked polyurethane composite explosives.

Thus, desensitized explosives such as RDX or HMX can be prepared by drying and simultaneously coating the as-received explosives, with particle sizes limited only by the desired application, at temperatures near 100° C. in a drier of suitable capacity to which desired amounts of a polyoxyethylene glycol such as a polyoxyethylene glycol of molecular weight approximately 4000, have been added. The degree of desensitization attained will be dependent, to some extent, upon the concentration of polyoxyethylene glycol coated on the explosive, such that concentrations as low as 0.5% of polyoxyethylene glycol by weight of RDX confer marginal desensitization to impact as determined by the Bureau of Mines and Bureau of Explosive Tests, and adequate desensitization to friction and spark initiation, whereas concentrations of polyoxyethylene glycol greater than approximately 2.5% by weight of RDX impart adequate desensitization for all Bureau of Explosives requirements for handling and transporting explosives.

Castable and readily curable high energy explosive compositions with excellent thermal stability can be formulated with explosives such as RDX or HMX that are desensitized in accordance with our invention with a range of polyoxyethylene glycol coatings, including, but not limited to, 0.5 to 5.0% of coating and/or co-coating agents by weight of explosive, by incorporating the said desensitized explosives in concentrations preferably equivalent to 75 to 81 wt.% of the neat explosive in composites containing the coated explosive an energetic diluent, additional elastomer (if desired), a crosslinking agent and a curing agent, the concentration of explosive in the composite, however, limited only by the desired processability, physical properties and explosive characteristics of said composite. The energetic diluent may be comprised of bis-(2,2-dinitropropyl) formal (BDNPF) or bis-(2,2-dinitropropyl) acetal (BDNPA), and/or any mixture thereof, in concentrations up to and including at least 90% by weight of the binder. The additional readily curable elastomer may be polyoxyethylene glycol or energetic copolymers of dinitropropylacrylate with hydroxyethylacrylate, or other desirable materials. Cure at mild conditions to rigid or flexible polymers may be effected by adjusting the concentration of suitable crosslinkers such as, but not limited to trimethylolpropane (TMP) and suitable isocyanate curing agents such as, but not limited to tolylene diisocyanate (TDI) or polymethylene polyphenyl isocyanate (PAPI). Other materials, such as, but not limited to metallic ingredients such as aluminum, antioxidants, antifoaming agents, polymerization catalysts and additional explosive desensitizing agents may be included in these compositions without deleterious effects on the desensitized, coated neat explosive to be incorporated, nor on the processability, ambient cure, sensitivity, mechanical properties or explosive characteristics of the composite explosives.

Polyoxyethylene glycol (PEG) in a wide range of molecular weights including 1450 and 20,000, and similar elastomers such as polyvinyl alcohols with varying degrees of hydroxyl functionality, were first employed as phlegmatizing agents for HMX by simultaneously drying and coating as-received HMX with 2 to 12% of the desensitizing elastomers. These agents when coated on HMX decreased sensitivity, as measured by the Bureau of Mines Impact Machine in the following manner:

in sensitivity of material coated with 3% polyoxyethylene glycol as compared with dry, uncoated RDX.

Table 1

COMPARISON OF SAFETY AND SENSITIVITY DATA OF DRY, UNCOATED RDX AND RDX COATED WITH 3% OF POLYOXYETHYLENE GLYCOL (PEG 4000)

| | RDX Dry, Uncoated | RDX, 3% PEG Coating, 1 lb Batch | RDX, 3% PEG Coating, 200 lb Batch |
|---|---|---|---|
| Bureau of Mines Impact Sensitivity, 50% pt, cm/2Kg | 32 | 47 | 56 |
| Bureau of Explosive Impact Sensitivity, 3-¾" drop | 1+, 9− | 0+,10− | 0+, 10− |
| 10" drop | 10+ | 1+, 9− | 6+, 4− |
| Spark Sensitivity, 50% pt, Joules | 0.025–0.15 | 0.8 | 0.8 |
| Friction Sensitivity, 50% pt, at 6000 rpm, gram load | >4000 | >4000 | >4000 |
| DTA, Endothermic Peaks, °F. | 378 | 137,366,386 | 137,369,396 |
| DTA, Exothermic Peak, °F. | 452 | 445 | 462 |
| Moisture, % Surface | 0.005 | 0.021 | 0.012 |
| Total | — | — | 0.037 |
| PEG 4000, % | 0 | 3.0 | 3.0 |

| Explosive | Bureau of Mines Impact Sensitivity, cm/2Kg |
|---|---|
| HMX, dry uncoated | 11 |
| HMX, 2% PEG 1450 mol. wt. | 18 |
| HMX, 2% polyvinyl alcohol | 14 |
| HMX, 7% PEG 1450 mol. wt. | 36 |
| HMX, 12% PEG 1450 mol. wt. | 96 |

The following examples are presented solely to illustrate the invention.

EXAMPLE I

As-received RDX - Class A of particle size approximately 130 microns (474 grams) and as-received RDX - Class E of particle size approximately 30 microns (128 grams) each steeped in 10–20% of a water-isopropanol mixture, were simultaneously dried and coated with a solution containing 15.3 grams of polyoxyethylene glycol of approximately 4000 molecular weight in a 2000 cc Rinco evaporator for six hours at 175°–200° F. (approximately 80°–90° C.) under 30 inches of vacuum. Analysis of the coated RDX indicated 2.99% polyoxyethylene glycol coating and 0.021% $H_2O$. Safety and sensitivity data in Table 1 shows a significant decrease A composite explosive (Composition No. 1) fabricated by incorporating 83.5 wt.% of the coated explosive (81.0% RDX) into a solution containing 75% of a 1:1 BDNPF/BDNPA plasticized binder comprised of additional polyoxyethylene glycol of 2300 equivalent weight, trimethylol propane and tolylene diisocyanate, such that the total binder equivalents ratio is 15:85:107 (respectively), is particularly useful in, but not limited to, applications in fragmenting projectiles. This composition is sufficiently insensitive to shock to replace Explosive D in shells exposed to high shocks but gives considerably higher performance in fragmentation and acceleration of shell fragments and blast. It evolves less than 2 cc/gram of gas in 48 hours at 100° C., exhibiting good thermal stability. This composition was conveniently mixed as a 500 gram size batch in a Baker Perkins Vertical Mixer at 130°–140° F. to facilitate solution of the polyoxyethylene glycol coating, after which the temperature was dropped to 80°–85° F. during addition of the tolylene diisocyanate prior to casting. The properties of this and other similar formulations are shown in Table 2.

Table 2

COMPOSITE PROJECTILE EXPLOSIVES PREPARED WITH RDX(1) COATED WITH POLYOXYETHYLENE GLYCOL

| | Composition No. 1 | Composition No. 2 | Composition No. 3 |
|---|---|---|---|
| RDX,% | 81 | 80.5 | 80.5 |
| Castability at 80°–90° F. | Very good | Very good | Very good |
| Shore "A" Hardness, 6 days at 80° F. | 48 | 53 | 49 |
| Impact Sensitivity, cm/2Kg, 50% pt | 91 | — | 92.5 |
| DTA, Onset of Exotherm, °F. | 375 | 375 | 380 |
| DTA, Exothermic Peak, °F. | 442 | 441 | 454 |
| Friction Sensitivity at 6000 rpm, 50% pt, gm load | >4000 | >4000 | >4000 |
| Measured Density, g/cc | | — | 1.643 |
| Mechanical Properties at 77° F. | | | |
| $\sigma_m$, psi | — | — | 50 |
| $\epsilon_m$, % | — | — | 10 |
| $\epsilon_b$, % | — | — | 10 |
| $E_0$, psi | — | — | 817 |
| Detonation Pressure, Kbars | 301 | 300 | 300 |
| Detonation Energy, cal/gm | 1425 | 1424 | 1424 |
| Detonation Velocity, m/sec | 8378 | 8370 | 8370 |

Table 2-continued

| COMPOSITE PROJECTILE EXPLOSIVES PREPARED WITH RDX[1] COATED WITH POLYOXYETHYLENE GLYCOL | Composition No. 1 | Composition No. 2 | Composition No. 3 |
|---|---|---|---|
| Vacuum Stability, 100° C./48 hrs/ml gas/gram | — | — | 0.429 |
| Taliani Test, 100° C./48 hrs Pressure at 48 hrs, mm | — | — | 8 |

[1]All contained blends of RDX-Class A (approximately 30–80% between 149 and 300 microns) and RDX-Class E (approximately 97% less than 44 microns).

EXAMPLE II

A scaled up 200-lb batch of the bimodal blend of Class A and E RDX described in Example I was desensitized by coating the mixed explosives with 3% polyoxyethylene glycol by charging into a 5 cubic foot Patterson drier 185 lbs of as-received RDX-Class A and 51 lbs of as-received RDX-Class E, each steeped in 10–20% of a water-isopropanol mixture, and a solution containing 6 lbs of as-received polyoxyethylene glycol, mol wt. approximately 4000, in 600 cc of isopropanol, followed by a 600 cc isopropanol rinse. The RDX was dried for 6 hours at 175°–200° F. under 30 inches vacuum. Analytical and sensitivity test data of the coated product were similar to results obtained from the 1-lb batch of coated material as shown in Table 1. A 4000 gm batch (Composition No. 3) of composite explosive suitable for but not limited to case fragmentation and/or acceleration and blast applications prepared with the desensitized, PEG coated RDX, equivalent to 80.5% of RDX in the formulation, had properties similar to Composition No. 1 of EXAMPLE I, as shown in Table 2.

EXAMPLE III

Composition No. 2, suitable for acceleration of case fragments and blast was prepared in a 500 gram size batch with RDX desensitized with a polyoxyethylene glycol coating, was similar to Composition No. 1, but the temperature was maintained between 85°–95° F. throughout the mixing and casting operations.

EXAMPLE IV

Desensitized explosives, suitable for, but not limited to case fragmentation and/or acceleration, blast, and underwater explosive effects by simultaneously drying and coating 600 grams of as-received RDX-Class A (steeped in 10–20% of a water-isopropanol mixture) with 3% by wt. (of RDX) of a mixed coating containing 7 parts of PEG 4000 to 1 part of dioctyl adipate (DOA). The physical properties of this coated material are shown in Table 3 together with other coated materials for comparison.

Table 3

CHARACTERISTICS OF RDX WITH VARIOUS COATINGS

| Coating Run No. | RDX Class | Ratio of Coating Materials[1] PEG 4000 | DOA | NP | Tri-acetin | PEG 200 | DHA[4] | Ease of Discharge[2] from Flask after Coating, at °F., % 80 | 140 | Crushability with Soft Tool at 80° F. | Percent $H_2O$ Surface | Total |
|---|---|---|---|---|---|---|---|---|---|---|---|---|
| 1 | A | 7.0 | 1 | 0 | 0 | 0 | 0 | 80–90 | 100 | Yes | 0.032 | 0.040 |
| 2 | A | 5.0 | 1 | 0 | 0 | 0 | 0 | 100 | 100 | Yes | 0.025 | 0.061 |
| 3 | A | 5.0 | 1 | 0 | 0 | 0 | 0 | 80–90 | 100 | Yes | 0.014 | 0.035 |
| 4 | A | 5.0 | 1 | 0 | 0 | 0 | 0 | 80–90 | 100 | Yes | 0.030 | 0.039 |
| 5 | A | 3.3 | 1 | 0 | 0 | 0 | 0 | 100 | 100 | Yes | 0.017 | 0.037 |
| 6 | A | 5.0 | 0 | 1 | 0 | 0 | 0 | 100 | 100 | Yes | 0.024 | 0.047 |
| 7 | A | 5.0 | 0 | 0 | 1 | 0 | 0 | 100 | 100 | Yes | 0.022 | 0.055 |
| 8 | A | 5.0 | 0 | 0 | 1 | 0 | 0 | 80–90 | 100 | Yes | 0.019 | 0.035 |
| 9 | A | 5.0 | 0 | 0 | 0 | 1 | 0 | 80–90 | 100 | Yes | 0.019 | 0.030 |
| 10 | A | 1.0 | 0 | 0 | 0 | 0 | 0 | 80–90 | 100 | Yes | 0.012 | — |
| 17 | A | 14.0 | 0 | 0 | 0 | 0 | 1 | 20–30 | 100 | No | 0.038 | 0.045 |
| 11 | E | 6.0 | 1 | 0 | 0 | 0 | 0 | 20–30 | 100 | Yes | 0.032 | 0.079 |
| 12 | E | 5.0 | 1 | 0 | 0 | 0 | 0 | 20–30 | 100 | Yes | 0.014 | 0.070 |
| 13 | E | 5.0 | 1 | 0 | 0 | 0 | 0 | 20–30 | 100 | Yes | 0.014 | 0.052 |
| 14 | E | 5.0 | 0 | 0 | 1 | 0 | 0 | 20–30 | 100[3] | Yes | 0.025 | 0.038 |
| 15 | E | 5.0 | 0 | 0 | 1 | 0 | 0 | 20–30 | 100 | Yes | 0.016 | 0.033 |
| 16 | E | 5.0 | 0 | 0 | 0 | 1 | 0 | 20–30 | 100[3] | Yes | 0.014 | 0.021 |
| 18 | E | 14.0 | 0 | 0 | 0 | 0 | 1 | 20–30 | 100 | No | 0.028 | 0.047 |
| 19 | A/E | 1.0 | 0 | 0 | 0 | 0 | 0 | 20–30 | 100 | No | 0.012 | 0.038 |

[1]Total coating ≃ 3%
[2]Gentle scraping with a soft polyethylene spatula
[3]Could be readily discharged from flask by gentle scraping after warming to 110° F.
[4]Dihydroxyacetone acetone

EXAMPLE V

Desensitized explosives were prepared by simultaneously drying and coating 600 grms of as-received RDX-Class A (steeped in 10–20% of a water-isopropanol mixture) with 3% by wt. (of RDX) of a mixed coating containing 5 parts of PEG 4000 to 1 part of dioctyl adipate. Physical properties of this coated material are shown in Table 3. The sensitivity and stability characteristics of the coated material are shown in Table 4. Processing and mechanical properties of 500 gm size batches of composite explosives prepared with this variety of desensitized Class A RDX (equivalent to 48.2 wt% of a total of 75 wt% of RDX in the formulation) suitable for projectile applications are shown in Table 5.

Table 4

SENSITIVITY AND STABILITY OF RDX WITH 3% OF VARIOUS COATINGS

| Coating → Ratio → | RDX-A PEG/DOA 5/1 | RDX-A PEG/TA 5/1 | RDX-A PEG/NP 5/1 | RDX-A/E PEG 4000 |
|---|---|---|---|---|
| Bu Mines Impact, 50% pt, cm/2Kg | 57 | 62 | 51 | 56 |
| Bu Explosives Impact, 3-¾"drop | 10– | 10– | 10– | 10– |
| 10"drop | 2+, 8– | 8+, 2– | 4+, 6– | 6+, 4– |
| DTA, Endothermic Peaks, °F. | 364,388 | 370,390 | 366,391 | 137,369,396 |
| DTA, Onset of Exotherm, °F. | 388 | 395 | 391 | 396 |
| DTA, Exothermic Peak, °F. | 459 | 457 | 459 | 462 |
| Friction sensitivity, 50% pt, 4000 gm load, rpm | 6000 | 6000 | 6000 | 6000 |
| Spark Sensitivity, 50% pt, joules | 0.60 | 0.9 | 0.65 | 0.8 |

Table 5

EFFECT OF PROCESSING CONDITIONS AND RDX COATINGS ON THE MECHANICAL PROPERTIES OF COMPOSITE EXPLOSIVES

| Batch No. | Coated RDX Used(1) A | E | RDX Mix Conditions Temp. °F. | Time, Min. | Castability at 90° F. | Pot Life Hrs. | Equivalents Ratio(2) PEG 4000 | 200 | TMP | DHA(5) | Shore A Hardness 6 days 80° F. | Mechanical Properties at 80° F. $\delta_m$, psi | $\epsilon_m$, % | $\epsilon_b$, % | $E_o$, psi |
|---|---|---|---|---|---|---|---|---|---|---|---|---|---|---|---|
| 7504 | 2 | — | 90 | 20 | Fair | >8 | 13 | — | 87 | — | 38 | — | — | — | — |
| 7573 | 3 | 12 | 90 | 20 | Very good | >8 | 13 | — | 87 | — | 40 | 36 | 15 | 20 | 494 |
| 7617 | 3 | 12 | 90 | 40 | Very good | ~4 | 10 | — | 90 | — | 45 | 40 | 19 | 37 | 494 |
| 7656 | 4 | 13 | 90 | 60 | Very good | 2-3 | 7 | — | 93 | — | 33 | 30 | 11 | 16 | 449 |
| 7684 | 7 | 14 | 90 | 60 | Excellent | >8 | 7 | — | 93 | — | 30(3) | 29 | 28 | 38 | 177 |
| 7718 | 7 | 14 | 90 | 60 | Very good | >8 | 13 | — | 87 | — | 36 | 41 | 19 | 26 | 535 |
| 7774 | 10 | 16 | 90 | 60 | Excellent | ~6 | 8 | 7 | 85 | — | 39 | 29 | 11 | 14 | 402 |
| 7815 | 9 | 16 | 90 | 60 | Excellent | >8 | 7.5 | 22.5 | 70 | — | 40 | 43 | 14 | 15 | 474 |
| 6601(4) | — | — | 90 | 20 | Excellent | >8 | 15 | — | 85 | — | 43 | 38 | 11 | 13 | 555 |
| 8043 | 17 | 18 | 100 | 60 | Excellent | >8 | 7.5 | — | — | 22.5 | 43 | — | — | — | — |
| 8119 | 17 | 18 | 135 | 60 | EXcellent | >8 | 7.5 | — | — | 22.5 | 43 | 30 | 18 | 19 | 284 |

(1)See Table 3 for composition.
(2)All contained 107 equivalents of TDI.
(3)Cured 5 days at 80° F., then 10 days at 135° F., batch contained 0.01% catalyst, all other contained 0.025% catalyst
(4)Control: RDX-A and RDX-E coated with 0.5% DOA
(5)Dihydroxyacetone.

EXAMPLE VI

Desensitized explosives were prepared by simultaneously drying and coating 600 grams of as-received RDX-Class A (steeped in 10–20% of a water-isopropanol mixture) with 3% by wt. (of RDX) of a mixed coating containing 3.3 parts of PEG 4000 to 1 part of dioctyl adipate. Properties of this coated material are shown in Table 3.

EXAMPLE VII

Desensitized explosives were prepared by simultaneously drying and coating 600 grams of as-received RDX-Class A (steeped in 10–20% of a water-isopropanol mixture) with 3% by wt. (of RDX) of a mixed coating containing 5 parts of PEG 4000 to 1 part of nitroplasticizer (a 1:1 mixture of BDNPF and BDNPA). Properties of the coated explosive are shown in Table 3. Physical properties of a 5:1 mixture of PEG 4000 and nitroplasticizer shown in Table 6, indicate that lower compressive strength, compressive modulus, melting range and hardness are possible as compared with PEG 4000 or PEG 4000/DOA mixtures, thus permitting wider latitude in processing conditions of the coated explosives if desired. Sensitivity and stability characteristics of the coated explosive are shown in Table 4.

Table 6

PHYSICAL PROPERTIES OF COATINGS FOR RDX

| Composition | Ratio | Compressive Strength at 80° F. max., $\sigma_m$, psi(1) | Compressive Modulus at 80° F. $E_o$ psi(1) | Type of Break | Melting Range, °C. | Shore A Hardness Initial | After 15 Sec. |
|---|---|---|---|---|---|---|---|
| PEG 4000 | — | 229 | 10,730 | Brittle | 60–62 | 92 | 92 |
| PEG 4000/DOA | 5:1 | 290(2) | 9,270 (2) | Brittle | 59–62 | 92 | 80 |
| PEG 4000/Nitro-plasticizer | 5:1 | 67 | 3,080 | Plastic | 49–54 | 55 | 21 |
| PEG 4000/Triacetin | 5:1 | 85 | 3,700 | Plastic Brittle(3) | 49–54 | 45 | 29 |
| PEG 4000/PEG 200 | 5:1 | 133 | 8,200 | Plastic Brittle(3) | 50–57 | 46 | 29 |
| PEG 4000/PEG 200 | 10:1 | 250 | 8,350 | Plastic Brittle(3) | 53–59 | 75 | 65 |

Table 6-continued

PHYSICAL PROPERTIES OF COATINGS FOR RDX

| Composition | Ratio | Compressive Strength at 80° F. max., $\sigma_m$, psi[1] | Compressive Modulus at 80° F. $E_o$ psi[1] | Type of Break | Melting Range, °C. | Shore A Hardness Initial | Shore A Hardness After 15 Sec. |
|---|---|---|---|---|---|---|---|
| PEG 4000/PEG 200 | 20:1 | 360 | 9,580 | Brittle | 56–60 | 87 | 78 |

[1]Compressed at rate of 0.5 inch per minute. Average of 2 tests except where otherwise indicated.
[2]Results from 1 test.
[3]Plastic-Brittle, some deformation before brittle failure.

EXAMPLE VIII

Desensitized explosives were prepared by simultaneously drying and coating 600 grams of as-received RDX-Class A (steeped in 10–20% of a water-isopropanol mixture) with 3% by wt. (of RDX) of a mixed coating containing 5 parts of PEG 4000 to 1 part of glyceryl triacetate (triacetin). Properties of this coated material are shown in Table 3 and its sensitivity and stability characteristics in Table 4. Processing and mechanical properties of 500 gram size batches of composite explosive prepared with this variety of desensitized Class A RDX (equivalent to 48.2 wt% of a total of 75 wt% of RDX in the formulation) suitable for case fragmentation and/or acceleration applications, are shown in Table 5.

EXAMPLE IX

Desensitized explosives, suitable for case fragmentation and/or acceleration, blast, and underwater explosive effects, by simultaneously drying and coating 600 grams of as-received RDX-Class A (steeped in 10–20% of a water-isopropanol mixture) with 3% by wt. (of RDX) of a mixed coating containing 5 parts of PEG 4000 mol wt. to 1 part of PEG 200 mol wt. Physical properties of a 5:1 mixture of PEG 4000 and PEG 200, shown in Table 6, indicate that lower compressive strength, compressive modulus, melting range and hardness, are possible as compared with PEG 4000 or PEG 4000/DOA mixtures, thus permitting wider latitude in processing conditions of the coated explosive, if desired. Properties of the desensitized explosive are shown in Table 3. Processing and mechanical properties of 500 gram size batches of composite explosives prepared with this variety of desensitized RDX (equivalent to 57.3 wt% of a total of 75 wt% of RDX in the formulation) suitable for case fragmentation and/or acceleration applications, are shown in Table 5.

EXAMPLE X

Desensitized explosives, suitable for case fragmentation and/or acceleration, blast, and underwater explosive effects, by simultaneously drying and coating 600 grams of as-received RDX-Class A (steeped in 10–20% of a water-isopropanol mixture) with 3% by wt. (of RDX) of a mixed coating containing 14 parts of PEG 4000 mol wt. to 1 part of dihydroxyacetone. Physical properties of the desensitized explosive are shown in Table 3. Processing and mechanical properties of 500 gram size batches of composite explosives prepared with this variety of desensitized Class A RDX (equivalent to 57.3 wt% of a total of 75 wt% of RDX in the formulation) suitable for, but not limited to projectile applications, are shown in Table 5. A range of useful mechanical properties are possible by adjusting the PEG 4000/dihydroxyacetone ratio on the coated explosive to more effectively utilize the unique affinity of the carbonyl group of dihydroxyacetone for RDX type materials.

EXAMPLE XI

Desensitized explosives were prepared by simultaneously drying and coating 600 grams of as-received RDX-Class E (steeped in 10–20% of a water-isopropanol mixture) with 3% by wt. (of RDX) of a mixed coating containing 6 parts of PEG 4000 to 1 part of dioctyl adipate. The properties of this coated material are shown in Table 3.

A composite explosive suitable for underwater explosive effects, such as those requiring a high bubble energy, is fabricated by incorporating 7.2 wt.% of the coated explosive (7.0% RDX-Class E with average particle size of 30μ) together with 49.8 wt.% of ammonium perchlorate with average particle size of 133μ and 25.8 wt.% of aluminum with average particle size range of 10–20μ into a solution containing 75% of a 1:1 BDNPF/BDNPA plasticized binder comprised of additional polyoxyethylene glycol of 2300 equivalent weight, trimethylol propane and tolylene diisocyanate such that the total binder equivalents ratio is 15:85:107 (respectively). This composition is conveniently mixed as a 550 gram size batch in a Baker Perkins Vertical Mixer at 130°–140° F. The properties are shown in Table 7.

Table 7

PROPERTIES OF COMPOSITE EXPLOSIVE SUITABLE FOR UNDERWATER EXPLOSIVE EFFECTS

| | Composition No. 4 |
|---|---|
| RDX Class E, % | 7.0 |
| Ammonium Perchlorate, % | 49.8 |
| Aluminum, % | 25.8 |
| Castability at 135° F. | Very Good |
| Shore "A" Hardness, 6 days at 135° F. | 67 |
| Impact Sensitivity, cm/2Kg, 50% pt | 15 |
| DTA, Onset of Exotherm, °F. | 343 |
| DTA, Exothermic Peaks, °F. | 484,674 |
| Friction Sensitivity, 50% pt. 500 gm load, rpm | 3100 |
| Measured Density, g/cc | 1.915 |
| Mechanical Properties at 77° F. | |
| $\sigma_m$, psi | 178 |
| $\epsilon_m$, % | 13 |
| $\epsilon_b$, % | 13 |
| $E_o$, psi | 1595 |
| Vacuum Stability, 100° C., 48 hrs/ml gas/gm | 0.468 |
| Taliani Test, 100° C./48 hrs. | |
| Pressure at 48 hrs, mm. | 63 |

EXAMPLE XII

Desensitized explosives were prepared by simultaneously drying and coating 600 grams of as-received RDX-Class E (steeped in 10–20% of a water-isopropanol mixture) with 3% by wt. (of RDX) of a mixed coating containing 5 parts of PEG 4000 to 1 part of dioctyl adipate. Physical properties of this coated material are shown in Table 3. Processing and mechanical properties of 500 gram size batches of composite explosives prepared with this variety of desensitized Class E RDX (equivalent to 26.8 wt% of a total of 75 wt% of RDX in the formulation) suitable for, but not limited to case fragmentation and/or acceleration and blast applications are shown in Table 5.

EXAMPLE XIII

Desensitized explosives were prepared by simultaneously drying and coating 600 grams of as-received RDX-Class E (steeped in 10–20% of a water-isopropanol mixture) with 3% by wt. (of RDX) of a mixed coating containing 5 parts of PEG 4000 to 1 part of triacetin. Physical properties of a 5:1 mixture of PEG 4000 and triacetin shown in Table 6, indicate that lower compressive modulus, melting range and hardness are possible as compared with PEG 4000 or PEG 4000/DOA mixtures, thus permitting wider latitude in processing conditions of the coated explosive, if desired. This is reflected in ease of discharge of the coated explosive from the drier at lower temperature ranges than is demonstrated by other desensitizing coatings, as shown in Table 3. Processing and mechanical properties of 500 gram size batches of composite explosive prepared with this variety of desensitized Class E RDX (equivalent to 26.8 wt% of a total of 75 wt.% of RDX in the formulation), suitable for, but not limited to case fragmentation and/or acceleration applications, are shown in Table 5.

EXAMPLE XIV

Desensitized explosives were prepared by simultaneously drying and coating 600 grams of as-received RDX-Class E (steeped in 10–20% of a water-isopropanol mixture) with 3% by wt. (of RDX) of a mixed coating containing 5 parts of PEG 4000 mol. wt. to 1 part of PEG 200 mol. wt. Physical properties of a 5:1 mixture of PEG 4000 and PEG 200 shown in Table 6, indicate that lower compressive strength, compressive modulus melting range and hardness are possible as compared with PEG 4000 or PEG 4000/DOA mixtures, thus permitting wider latitude in processing conditions of the coated explosive, if desired. This is reflected in ease of discharge of the coated explosive from the drier at lower temperature ranges than is demonstrated by other desensitizing coatings, as shown in Table 3. Processing and mechanical properties of 500 gram size batches with different polyol equivalent ratios prepared with this variety of desensitized Class E RDX (equivalent to 17.7 wt.% of a total of 75 wt.% of RDX in the formulation), suitable for, but not limited to case fragmentation and/or acceleration applications, are shown in Table 5. A range of useful mechanical properties are possible by adjusting the molecular weight ratio of mixed polyoxyethylene glycol desensitizing agents, and by altering the polyol equivalent weight ratios in the composite explosive formulation.

EXAMPLE XV

Desensitized explosives were prepared by simultaneously drying and coating 600 grams of as-received RDX-Class E (steeped in 10–20% of a water-isopropanol mixture) with 3% by wt. (of RDX) of a mixed coating containing 14 parts of PEG 4000 mol wt. to 1 part of dihydroxyacetone. Physical properties of the desensitized explosive are shown in Table 3. Processing and mechanical properties of 500 gram size batches of composite explosives prepared with this variety of desensitized Class E RDX (equivalent to 17.7 wt% of a total of 75 wt% of RDX in the formulation) suitable for, but not limited to case fragmentation and/or acceleration and blast applications, are shown in Table 5. A range of useful mechanical properties may be possible by adjusting the PEG 4000/dihydroxyacetone ratio on the coated explosive to more effectively utilize the unique affinity of the carbonyl group of dihydroxyacetone for RDX type materials.

EXAMPLE XVI

Desensitized explosives were prepared by simultaneously drying and coating a mixture comprised of 474 grams of as-received HMX-Class A of particle size approximately 150 microns and 128 grams of as-received HMX-Class E of particle size approximately 30 microns (each steeped in 10–20% of a water-isopropanol mixture) with a solution containing 15.3 grams of polyoxyethylene glycol of approximately 4000 mol wt. in 40 cc of isopropanol, in a 2000 cc Rinco Evaporator for 6 hours at 175°–200° F. (approximately 80°–95° C.) under 30 inches of vacuum. Analysis of the coated HMX indicated 3.41% polyoxyethylene glycol coating, 0.006% surface water and 0.071% total water.

EXAMPLE XVII

As-received RDX-Class A of particle size approximately 130 microns (474 grams) and as-received RDX-Class E of particle size approximately 30 microns (128 grams) is simultaneously dried and coated with a solution containing 15.3 grams of polyoxyethylene glycol of approximately 4000 molecular weight in which part or all of the hydroxyl groups have been previously esterfied with a dicarboxylic acid such as azelaic acid, such that free carboxyl groups are available to react at some convenient time, with a triepoxide, for example, to form a composite explosive with a crosslinked polyepoxide binder. The desensitized explosive is suitable for, but not limited to case fragmentation and/or acceleration, blast, and underwater explosive effects.

A composite explosive is fabricated by incorporating 83.5 wt.% of the coated explosive (81.0% RDX) into a solution containing 75% of a 1:1 BDNPF/BDNPA plasticized binder comprised of additional carboxy substituted polyethylene glycol of 2300 equivalent weight and ERLA 0510, a triepoxide, such that the total binder equivalents ratio is 100:115 (respectively).

Sensitive neat explosives other than RDX or HMX coated with desensitizing agents containing functional groups include the perchlorates, such as ammonium perchlorate and hydrazine perchlorate. These compounds are coated with polyurethane and polyepoxy precursors, for example. Other RDX/HMX coating agents with functional groups that have been employed in propellants are as follows:

(a) Epoxy-amine (0.5 wt.% of RDX) (Methylene bis-p-aniline and resorcinol diglycidyl ether in a ½ mole ratio)

(b) Toluene diisocyanate-amine (0.5 wt.% of RDX) [4,4'-methylene-bis(2-chloroaniline) and toluene diisocyanate in 1/1 and ⅔ mole ratios ]

(c) Poly(1,4-butylene)glycol Mol. wt. approx. 1000 (1 and 5 wt.% of RDX)

(d) Poly neopentyl glycol azelate Mol. wt. approx. 2100 (1 wt.% of RDX)

(e) Epichlorohydrin/bisphenol A type epoxy resin (Epon 201) (0.1 wt.% of RDX)

(f) Polyvinyl alcohol (2 wt.% of HMX)

Having fully described the invention, it is intended that it be limited only by the lawful scope of the appended claims.

We claim:

1. A novel desensitized explosive comprising a normally sensitive solid explosive material coated with an effective desensitizing amount of a phlegmatizing agent which contains functional groups reactive with at least one ingredient conventionally used in forming a thermally stable, crosslinked solid composite explosive, and which is polyvinyl alcohol.

2. A novel desensitized explosive comprising a normally sensitive solid explosive material selected from the group consisting of RDX, HMX, perchlorates and mixtures thereof coated with an effective desentizing amount of a phlegmatizing agent which contains functional groups reactive with at least one ingredient conventionally used in forming a thermally stable, crosslinked solid composite explosive, and which is selected from the group consisting of a polyoxyethylene glycol, polycarboxylic acids, glycerol monoricinoleate, polyvinyl alcohol and mixtures thereof.

3. The desensitized explosive of claim 2 wherein said phlegmatizing agent is a polyoxyethylene glycol.

4. The desensitized explosive of claim 2 wherein said phlegmatizing agent is polyvinyl alcohol.

5. The desensitized explosive of claim 2 wherein said normally sensitive solid explosive is selected from the group consisting of RDX, HMX and mixtures thereof.

6. The desensitized explosive of claim 5 wherein said phlegmatizing agent is a polyoxyethylene glycol.

7. A novel solid homogeneous composite explosive comprising a crosslinked polymeric binder in which a normally sensitive solid explosive material is coated with an effective desensitizing amount of a phlegmatizing agent which is selected from the group consisting of a polyoxyethylene glycol, polycarboxylic acids, glycerol monoricinoleate, polyvinyl alcohol and mixtures thereof, wherein the coated desensitized solid explosive is intergrally and chemically bound by reaction of the coating with the binder ingredient.

8. The novel solid homogeneous composite explosive of claim 7 wherein the phlegmatizing agent is a polyoxyethylene glycol.

9. A novel solid homogeneous composite explosive comprising a crosslinked polymeric binder in which the coated desensitized solid explosive of claim 2 is integrally and chemically bound by reaction of the coating with the binder ingredient.

10. A novel solid homogeneous composite explosive comprising a crosslinked polymeric binder in which the coated desensitized solid explosive of claim 3 is integrally and chemically bound by reaction of the coating with the binder ingredient.

11. A method of desensitizing a normally sensitive solid explosive material selected from the group consisting of HMX, RDX, perchlorates and mixtures thereof, comprising coating said sensitive solid explosive with an effective amount of a desensitizing agent selected from the group consisting of a polyoxyethylene glycol, polycarboxylic acids, glycerol monoricinoleate, polyvinyl alcohol and mixtures thereof.

12. The method of claim 11 wherein said normally sensitive solid explosive is selected from the group consisting of RDX, HMX, and mixtures thereof.

13. The method of claim 11 wherein said desensitizing agent is a polyoxyethylene glycol.

14. The method of claim 12 wherein said desensitizing agent is a polyoxyethylene glycol.

* * * * *